United States Patent [19]

Townsend et al.

[11] Patent Number: 4,750,269

[45] Date of Patent: Jun. 14, 1988

[54] FIREARM SIGHT-IN DEVICE

[76] Inventors: Ellsworth D. Townsend; Gerald L. Townsend, both of Rte. 2, Box 218, Boat Landing Rd., Wausaukee, Wis. 54177

[21] Appl. No.: 514

[22] Filed: Jan. 5, 1987

[51] Int. Cl.[4] ..... F41G 1/54

[52] U.S. Cl. ..... 33/234; 279/2 R

[58] Field of Search ..... 33/234, 245, 286; 279/2 R; 356/138, 153

[56] References Cited

U.S. PATENT DOCUMENTS

| | | | |
|---|---|---|---|
| 1,295,075 | 2/1919 | Sheppard | 33/234 |
| 2,353,272 | 7/1944 | Simmons et al. | 33/234 |
| 2,476,981 | 7/1949 | Horton | 73/1 |
| 2,696,052 | 12/1954 | Czarnikow | 33/234 |
| 2,819,527 | 1/1958 | Spurling | 33/234 |
| 3,112,567 | 12/1963 | Flanagan | 33/234 |
| 3,612,949 | 9/1969 | Becraft et al. | 356/153 |
| 3,744,133 | 7/1973 | Fukushima et al. | 33/234 |
| 4,057,905 | 11/1977 | Piaja | 33/234 |
| 4,090,305 | 5/1978 | Cassidy | 33/234 |
| 4,534,116 | 8/1985 | Davis | 33/234 |

FOREIGN PATENT DOCUMENTS

| | | | |
|---|---|---|---|
| 647136 | 6/1937 | Fed. Rep. of Germany | 33/234 |

*Primary Examiner*—Richard R. Stearns

*Attorney, Agent, or Firm*—Willian Brinks Olds Hofer Gilson & Lione Ltd.

[57] ABSTRACT

A device for sighting-in firearms is disclosed. The device comprises a telescope connected to a mandrel. The mandrel is sized to fit within a variety of calibers of gun bores. The mandrel has a tapered sleeve with a conical shape which centers the outside end of the sleeve in the outside end of the firearm bore. The inside end of the sleeve has a circumferentially expandable structure which allows the sleeve to be secured in the center of the bore when flared by the head of a slideable mandrel core. The telescope is connected to the mandrel with an optical arrangement through which the line of sight of the telescope is observable. The mandrel is constructed so that when the device is inserted in the bore of a firearm, the line of sight of the telescope is centered with and parallel to the axis of the mandrel, which is also the axis of the firearm bore.

12 Claims, 2 Drawing Sheets

FIREARM SIGHT-IN DEVICE

BACKGROUND OF THE INVENTION

This invention relates to devices for sighting in firearms, and more particularly to devices for accurately positioning the firearm sight to correspond to the point of impact of projectiles expelled from said firearms.

Firearms are often equipped with sights which a person using the firearm uses to aim the firearm. The sights often comprise a telescope which allows the user a magnified view of his target. Such telescopes include reticles (cross hairs) observable while viewing a target through the telescope. The process of "sighting-in" the firearm consists of aligning the firearm sights, particularly the telescope cross hairs, so as to accurately correspond to the point of impact of projectiles fired from the firearm.

Each caliber of firearm (and even similar calibers made by different manufacturers) and bullet muzzle velocity results in a different bullet trajectory. All trajectories are nearly parabolic due to gravity. Thus, firearms are generally sighted-in for the muzzle velocity and distance of bullet travel expected in actual use. For example, a hunter will sight in his particular caliber rifle for shooting a particular bullet at a particular distance.

One method of sighting-in firearms is to shoot at the center of a target located at the desired distance. The point where the bullet actually strikes the target is noted, the firearm sights are adjusted, and the process is repeated until the desired accuracy is obtained.

Various devices have been designed to aid in sighting-in firearms. For example, U.S. Pat. No. 1,295,075 to Sheppard discloses a bore sighting device which mounts in the end of a firearm bore and sets up a line of sight parallel with the axis of the bore mounting segment of the device. Likewise, U.S. Pat. No. 3,112,567 to Flanagan describes a device mountable in the end of a rifle which includes marks to which the rifle telescope can be adjusted depending on the expected target distance. U.S. Pat. No. 3,744,133 to Fukushima discloses a collimating device which has a conical surface to center the device in various calibers of firearms. U.S. Pat. No. 4,090,305 to Cassidy also discloses a device to be mounted in the end of a gun barrel in an aid to sighting-in the sights on the gun.

One common problem with all of the above devices is that when used, the firearm is sighted-in on a device at the end of the barrel, only a foot or two at most from the gun sights. Therefore, any slight error made while sighting-in using the device will be greatly magnified when shooting at a target several hundred yards away. Even if the precision of alignment were ±0.01 inches for a device mounted 2 feet from the guns telescope, at 300 yards the precision would be ±4.5 inches, or about a 10 inch diameter circle, Thus, these types of prior art devices are typically used only as a first approximation, and actual target shooting is required to sight the firearm in with the desired degree of accuracy.

German Patentschrift No. 647,136 describes a device for checking the accuracy of the sighting mechanism of a gun. The device uses a prismatic telescope in an optical arrangement designed to view along the axis of bore to check the accuracy of the gun sighting device. A problem common to the disclosed device and the previously discussed devices is the lack of accuracy in lining up the device itself with the axis of the firearm bore. In the case of the German reference, the optical device is mounted in the bore of the gun on a mandrel which includes two spherical bearing surfaces. In order that such a mandrel could be inserted into and removed from the bore, there must be sufficient clearance between the inside of the bore and the bearing surfaces to allow such placement without harm to the inside of the bore. Any freeplay between the mandrel and bore will result in a slight angle between the axis of the bore and the axis of the optical arrangement mounted on the mandrel. The small moment of error thus present will affect the accuracy to which the gun can be sighted-in. Another disadvantage is that a separate mandrel must be used for each caliber.

The devices disclosed in the Cassidy and Fukushima et al. patents use a compressible member to expand within the bore in an attempt to hold the devices in line with the axis of the bore. The nature of the expandable means used, however, makes it very difficult to insure exact centering. The device disclosed in the Flanagan patent is mounted only at the mouth of the bore.

SUMMARY OF THE INVENTION

The device of the present invention comprises a telescope connected to a mandrel, the mandrel being sized to be insertable within a variety of calibers of gun bores. The mandrel has a tapered sleeve which at the outside end is conically shaped to center the outside end in the end of the bore. The inside end of the sleeve has an expandable means. Inside the sleeve is a slideable mandrel core, including a flared head at the inside end. Means for sliding the core are provided which cause the inside end of the mandrel sleeve to expand and securely center the mandrel in the bore. The telescope is connected to the mandrel with an optical arrangement through which the line of sight of the telescope is observable.

The present invention provides a mandrel which securely centers the sight-in device within the axis of the firearm bore. Using the device it is possible to sight-in a firearm without firing repeated shots.

The device of the present invention is useful in sighting-in a wide variety of calibers of firearms, giving the device a wider range of usage than a device sized for one caliber or a narrow range of firearm calibers.

Further aspects and advantages of the invention will be best under stood in view of the detailed description of the invention and the drawings, a brief description of which follows.

BRIEF DESCRIPTION OF THE DRAWINGS OF THE PREFERRED EMBODIMENT OF THE INVENTION

DETAILED DESCRIPTION OF THE DRAWINGS AND THE PREFERRED EMBODIMENT OF THE INVENTION

Figure 1:
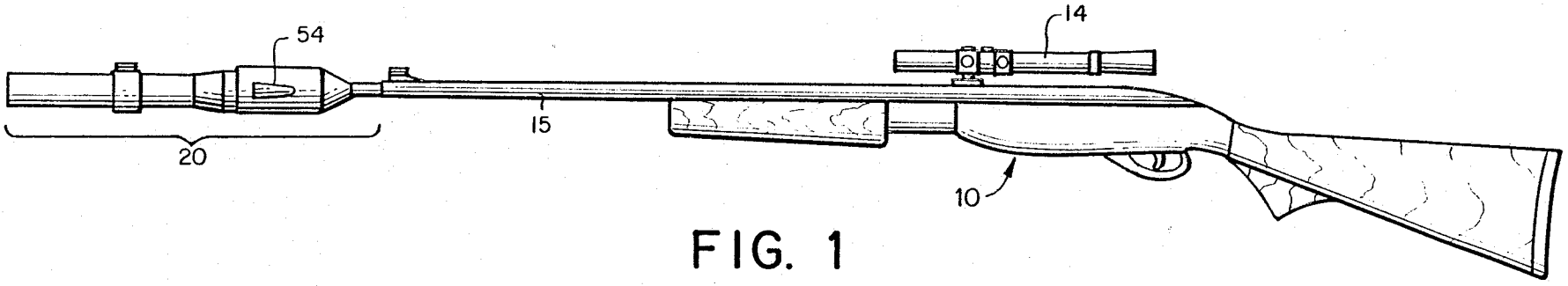
FIG. 1 is a side view of the device of the preferred embodiment of the invention mounted with a rifle.

FIG. 1 shows the preferred embodiment of the present invention mounted in the barrel 15 of a rifle 10. The sight-in device 20 is useful in sighting-in rifles, pistols, and any firearm which includes sights for accurately aiming the firearm. The device will be most useful, of course, when the sights on the firearm provide a high degree of accuracy in aiming, such as the telescope 14. As used herein, the term "sight-in" refers both to the initial accuracy adjustment of a firearm's sight and also to checking the accuracy of a firearm which has previously had its sights accurately adjusted.

Figure 2:
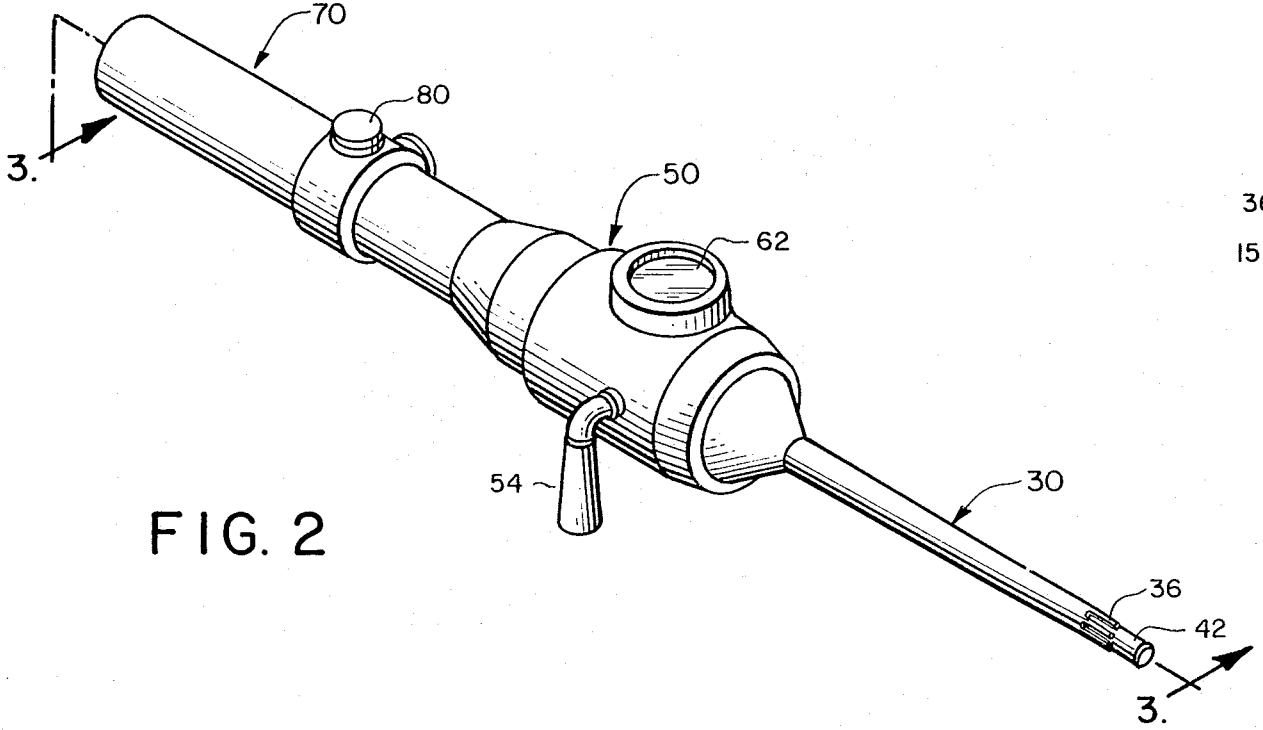
FIG. 2 is a perspective view of the device shown in FIG. 1.
Figure 3:
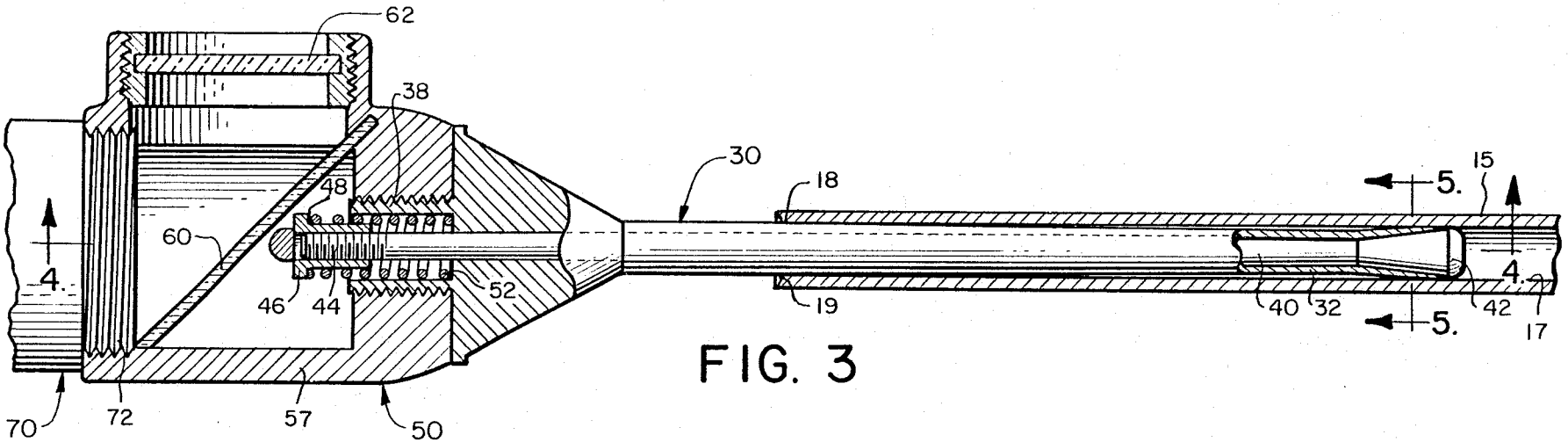
FIG. 3 is a sectional view taken along line 3—3 of FIG. 2.

As shown in FIG. 2, the sight-in device 20 comprises three major sections, a mandrel 30, a housing 50 and a telescope 70. The mandrel 30 comprises a mandrel sleeve 32 and mandrel core 40, best shown in FIG. 3. The sleeve is tapered so that its outside diameter narrows going from the outside end to the end inside the bore 17 of the rifle barrel 15. This taper allows the mandrel 30 to be centered in the bores of a wide variety of calibers, such as bores ranging in caliber from about 0.25 inches to 0.40 inches. Of course, other sizes of mandrel sleeves may be constructed for bores outside this range.

The taper must be narrow enough so that the sleeve 32 centers on the outside end 18 of the bore 17 and not the chamfer 19 normally found at the end of most barrels. This is because the chamfer 19 may not be concentric with the bore 17. On the other hand, the larger the taper, the greater variety of bores the mandrel will fit without being of an excessive length. A range of 1° to 10° is preferred on the taper of the sleeve, with a 2° taper being the most preferred.

On its inside end, the sleeve 32 includes four longitudinal slots 34, leaving four fingers 36 in between. See FIGS. 4 and 5. In addition, the inside diameter of the sleeve 32 at the inside end is tapered, getting thinner towards the inside end of the sleeve. See FIG. 3. The sleeve 32 on its extreme outside end is attached to the housing 50 by a threaded nipple 38.

Slideably mounted inside sleeve 32 is the mandrel core 40. The core 40 includes a flared head 42 on the inside end. The flared head 42 has a conical outside shape substantially the same as the inside diameter taper of the fingers 36. The core 40 is longer than the sleeve 32, extending into the housing 50. This end of the core 40 includes threads 44 onto which a nut 46 is secured. The nut 46 includes a shoulder 48.

Surrounding the nut 46 and bearing against shoulder 48 is a spring 52. The nipple 38 is hollow over most of its length, allowing the spring 52 to fit within the nipple 38 and surround nut 46 and the threaded portion of core 44. The natural tendency of spring 52 is to bias the flared head 42 of the core 40 against the fingers 36 of the sleeve 32.

The shape of the flared head 42 causes the fingers 36 to spread apart. Thus the fingers and slots form a circumferential expandable means at the inside end of the mandrel sleeve 32. When expanded, the inside end of the sleeve 32 engages the bore 17 and secures the inside end of the mandrel 30 in the center of the bore 17. The mandrel 30, when in this position, is secured at two points inside the bore 17 of the firearm, aligning the axis of the mandrel sleeve 32 with the axis of the bore 17.

Figure 4:
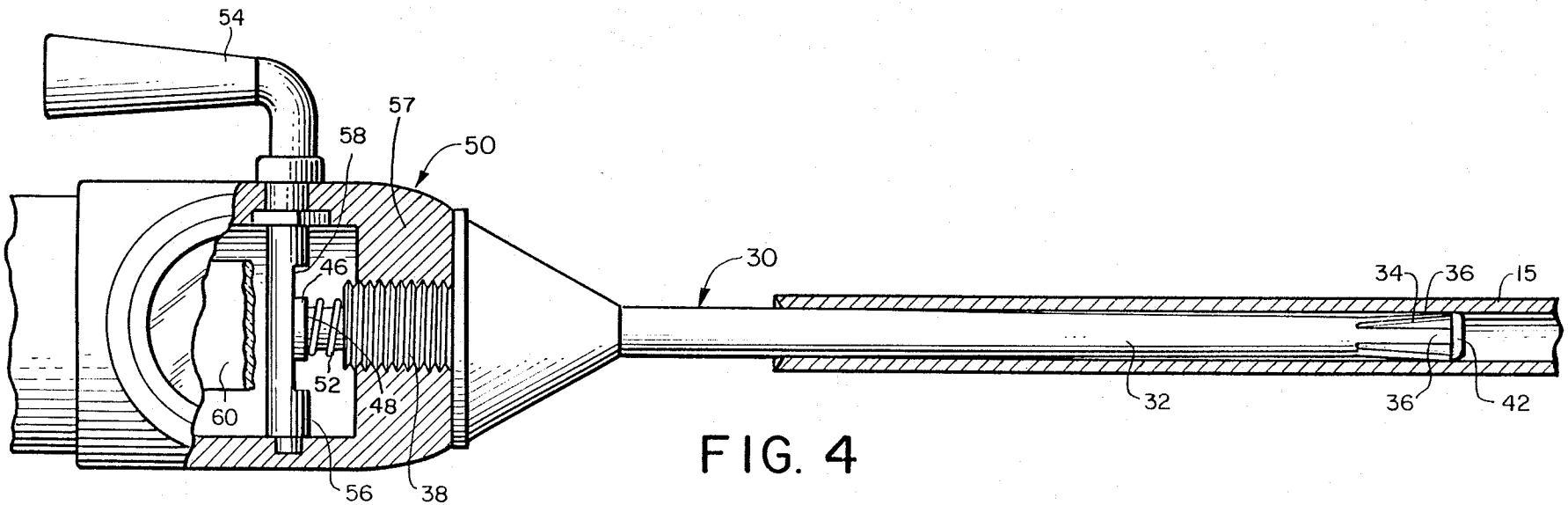
FIG. 4 is a partial sectional view taken along line 4—4 of FIG. 3.

The housing 50 includes a body 57 providing the physical structure to connect the mandrel 30 with the telescope 70. The housing 50 also includes several other components which allow for mechanical actuation of the mandrel core 40 and provide an optical arrangement through which to view the line of sight through the telescope 70. As seen in FIG. 4, a lever 54 is connected to a cam 56 journaled in the housing body 57. The cam is cylindrical in shape except for a flattened area 58. In the position depicted in FIG. 4, the flattened area 58 is aligned with the nut 46, allowing the spring 52 to force the flared head 42 of the mandrel core 40 as far as possible into the sleeve 32. Turning the lever 54 through 90° or more rotates the cam 56 so that the nut 46 compresses the spring 52 and slides the core 40 further into the bore 17. As a result, the flared head 42 disengages the fingers 36, allowing the expanded inside end of the mandrel sleeve 32 to return to its normal shape. In this position, the mandrel 30 may be removed from or inserted into the bore 17. Appropriate stops (not shown) are provided on he housing 50 to control the angle through which the lever 54 may be turned.

The optical arrangement inside the housing 50 includes a flat mirror 60 mounted at a 45° angle with respect to the axis of mandrel 30. The top of the housing 50 includes a hole and an eyepiece 62 through which reflections off the mirror 60 may be viewed.

The optical arrangement of the telescope 70 is not critical to the present invention, and any suitable telescope may be used. A preferred telescope is the Leopold M8-6x compact rifle scope. The housing on the telescope 70 is modified to provide a threaded nipple 72 which screws into the housing body 57. By looking through eyepiece 62, the line of sight, including the reticle, of the telescope 70 may be viewed as it reflects off mirror 60.

To use the device 20 to adjust the sights of a firearm, the device 20 itself must be first calibrated for the caliber of firearm for which it will be used. To do this, the device 20 is first secured in the bore 17 of the firearm using the lever 54 as previously described. The firearm is then placed on a steady surface and positioned so that the line of sight of the device 20 as viewed through he eyepiece 62 intersects an aim point. Without disturbing the firearm, the firearm sights are adjusted to also line up on the aim point. If the firearm is accidently moved during this step, several repetitions of positioning the firearm and adjusting its sights may be necessary in order to get the line of sight of the device 20 and the firearm sights to intersect on the aim point.

Next, the device 20 is removed from the firearm. A single shot is then fired at a target the distance away at which the firearm is being sighted-in (for example, 200 yards) using the sights of the firearm to aim at the target. The firearm should be held very steady while this shot is fired.

The device 20 is again secured in the bore 17 of the firearm, and the firearm positioned so that the line of sight of the device 20 intersects the target. The firearm sights are then adjusted to intersect the hole made by the bullet fired in the previous step. When the firearm sights and line of sight of the device 20 line up, at the same time, with the bullet hole and the target respectively, the firearm is sighted in.

One further step allows the device 20 to be used later to verify that the firearm is still sighted in. While the firearm is still positioned so that the firearm sights are in line with the bullet hole, the adjustments 80 (FIG. 2) on the telescope 70 of the device are adjusted so that the line of sight of the telescope 70 also intersect the bullet hole.

After this procedure, the device 20 can be used to verify that the sights on the firearm are correct. For example, after long periods of disuse, or after the sights have been bumped or replaced, the sights on the firearm can be accurately adjusted without firing a shot by inserting the calibrated device 20 into the bore of the firearm and adjusting the sights of the firearm to align with the line of sight of the device 20 at the desired sight-in distance. Since this verification or sighting-in is performed without firing a shot, it is possible to sight in the firearm in situations where traditional sighting-in procedures are not practical.

It has been found that once the device 20 has been calibrated for a given firearm, it can be used to adjust or verify the sights on firearms shooting bullets which have trajectories similar to the trajectory for which the device 20 was calibrated. Of course, if the trajectory is significantly different (either because a different muzzle velocity or caliber bullet is used), greater accuracy can be achieved for sighting-in the new firearm by first recalibrating the device for the new trajectory. However, when the differences in bullet trajectories is relatively small (as is most often the case), the calibrated device 20 may be used to quite accurately sight in a variety of firearms without the need for recalibration. The method of mounting the mandrel 30 in the bore 17 and the internal alignment between the mandrel 30 and telescope 70 of the device 20 provide a high degree of accuracy which more than compensates for small differences in trajectories, as compared to the limits of accuracy provided by prior art devices.

Figure 5:
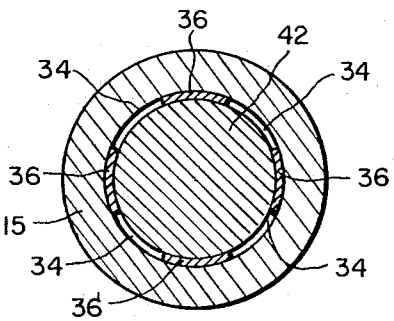
FIG. 5 is a sectional view taken along line 5—5 of FIG. 3.

In the preferred embodiment, the mandrel sleeve is approximately 4 inches long. A longer sleeve is preferred if the range of calibers to be sighted in is fairly narrow. The tapered end of the mandrel core is bronze. The housing 50 and mandrel 30 are made of aluminum to be light weight. As shown in FIG. 5, the slots 34 are made in the sleeve 32 so that a finger 36, rather than a slot 34, is at the top (12 o'clock) position. In this manner, the weight of the device 20 acts directly against a metallic surface, which helps make sure the inside end of the mandrel 30 remains centered.

In order to achieve the best alignment, it has been found that the sleeve 32 and housing 50 should be constructed from the inside out. Thus, to make the sleeve 32, a piece of stock material is first drilled through. Then the stock is turned to the proper outside dimensions while centered about this initial bore. The threaded nipple 38 and tapered inside end are also machined while the stock rotates about this inside hole. Likewise, the holes into which the telescope 70 and mandrel 30 screw into the housing body 57 are made from a common centerline.

In a less preferred embodiment, the telescope 70 may be mounted on a bracket which is attached to the mandrel and which supports the telescope from its bottom using traditional telescope mounts. If the bracket is not shaped so as to center the telescopic line of sight with the bore axis, the offset distance must be accounted for in the final sight-in adjustments.

From the foregoing it will be evident that the device of the present invention makes it possible to accurately and quickly sight-in a firearm. Once the device 20 has been calibrated for the desired trajectory, firearm shooting bullets of similar trajectories can be sighted in without firing a shot. This reduces the danger associated with sighting-in a firearm, makes it possible to sight-in at night (using a light as the "target") or in an area such as around a hunting camp where noise is undesirable, and saves on costly ammunition otherwise used during the sighting-in process. Also, the device can be used to check the accuracy of the sights on a firearm previously sighted-in, or determine if the line of sight through a variable power telescope changes as the magnification factor is changed.

The design of the mandrel 30 provides a sure, center alignment of the device 20 with the bore 17 of a variety of calibers of firearms. The actuating system including the lever 54, cam 58, slideable core 40 and flared head 42, provide an easily operated mechanism to cooperate with the mandrel 30 to quickly insert and secure or remove the device 20 in or from the firearms being sighted-in.

The presently preferred embodiment of the invention has been described and given as an illustrative example. Since numerous modifications and changes may be made without departing from the invention, it is not desired to limit the invention to the exact construction and operation shown. Accordingly, all suitable modifications and equivalents may be resorted to without departing from the present invention, the scope of which is defined by the following claims.

We claim:

1. A device for sighting in firm arms comprising:

(a) a telescope, (b) an optical arrangement connected to the telescope through which to observe the line of sight through the telescope, (c) a mandrel attached to the optical arrangement parallel with the line of sight of the telescope comprising:

(i) a tapered mandrel sleeve sized to fit within the bores of a variety of caliber of firearms, the sleeve including circumferential expandable means at its small diameter inside end and tapering outwardly in a conical shape to its large diameter outside end;

(ii) a mandrel core slideably mounted within said sleeve, including a flared head at the inside end; and (iii) means for sliding said core within said sleeve to expand said expandable means, and (d) compressible biasing means associated with said core to normally force said flared head to expand said expandable means, (e) whereby when said mandrel is inserted in a firearm bore, said tapered conical shape centers said outside end of the mandrel in the end of the bore and said expandable means expands to center said inside end of the mandrel within the bore.

2. The device of claim 1 wherein the mandrel sleeve tapers from about 0.25 in. at its midsection to about 0.40 in. at its outside end.

3. The device of claim 1 wherein the circumferential expandable means of the inside end of the mandrel sleeve comprises a plurality of slots and fingers of the sleeve material.

4. The device of claim 3 wherein the segments of the mandrel sleeve in between said slots are tapered to form a conical shape inside the inside end of the sleeve, generally corresponding to the shape of the flared head on the mandrel core.

5. The device of claim 4 wherein the plurality of slots comprises four longitudinal slots spaced at approximately 90° increments around the circumference of the sleeve.

6. The device of claim 1 wherein the core includes a portion extending beyond the outside end of the sleeve and the compressible biasing means comprises a spring acting on the extended portion of the mandrel core.

7. The device of claim 6 wherein the extended portion of the mandrel core is threaded and a nut threaded on the extended portion provides a means of retaining the spring on the extended portion and transmitting biasing forces from the spring to the mandrel core.

8. The device of claim 7 further comprising a housing in which the optical arrangement is housed, the extended portion of the mandrel core extending into said housing, and the device further comprising a lever and cam pivotally mounted in said housing, said lever being positioned such that when activated said cam bears against said extended core portion to oppose said compressible biasing means and slide said core within said sleeve.

9. The device of claim 1 further comprising a housing in which the optical arrangement is housed, said optical arrangement comprising a mirror, and said line of sight being centered with the axis of the bore.

10. The device of claim 1 wherein the taper of the mandrel sleeve is at an angle of approximately 1° to 10° with the axis of the sleeve.

11. The device of claim 1 wherein the taper of the mandrel sleeve is at an angle of approximately 2° with the axis of the sleeve.

12. A device for sighting in firearms comprising:

(a) a telescope;

(b) a housing connected to the telescope, said housing including:

(i) a mirror, (ii) an eyepiece through which to observe light passing through the telescope and reflected by said mirror, and (iii) a lever pivotally mounted to a cam journaled within the housing;

(c) a mandrel attached to the housing opposite the telescope and insertable within the bore of a variety of calibers of firearms to align the line of sight of the telescope with the axis of the firearms bore, said mandrel comprising:

(i) a tapered mandrel sleeve sized to fit within the bore, the sleeve including longitudinal slots at its small diameter inside end and a conical surface at its large diameter outside end, (ii) a mandrel core slideably mounted within said sleeve, including a flared head at the inside end and a threaded portion extending beyond the outside end of the mandrel sleeve and into the housing, (iii) a nut threaded on said threaded portion, (iv) a spring biased between the nut and the housing so as to force said flared head into the slotted end of the mandrel sleeve; and (d) said lever, mandrel sleeve, core, nut and spring cooperating so that (1) when said lever is activated the core slides within the mandrel sleeve so that the flared head does not flare the slotted end of the sleeve and the mandrel can be removed from or inserted into a bore up to the point where the conical surface engages the end of the bore and so that (2) when the lever is released the spring urges the flared head of the core to flare the slotted end of the sleeve so as to secure the inside end of the mandrel in the center of the bore.

* * * * *

UNITED STATES PATENT AND TRADEMARK OFFICE

CERTIFICATE OF CORRECTION

PATENT NO. : 4,750,269

DATED : June 14, 1988

INVENTOR(S) : Ellsworth D. Townsend et al.

It is certified that error appears in the above-identified patent and that said Letters Patent is hereby corrected as shown below:

IN THE BACKGROUND OF THE INVENTION

In column 1, line 56, after "circle" please delete --,-- and substitute therefor --.--.

IN THE SUMMARY OF THE INVENTION

In column 2, line 50, please delete "under stood" and substitute therefor --understood--.

IN THE DETAILED DESCRIPTION OF THE DRAWINGS AND THE PREFERRED EMBODIMENT OF THE INVENTION

In column 4, line 21, please delete "he" and substitute therefor --the--.

In column 4, line 43, please delete "he" and substitute therefor --the--.

In column 5, line 40, please delete "light weight" and substitute therefor --lightweight--.

In column 5, line 51, please delete "bore" and substitute therefor --hole--.

UNITED STATES PATENT AND TRADEMARK OFFICE

CERTIFICATE OF CORRECTION

PATENT NO. : 4,750,269

DATED : June 14, 1988

INVENTOR(S) : Ellsworth D. Townsend et al.

It is certified that error appears in the above-identified patent and that said Letters Patent is hereby corrected as shown below:

IN THE CLAIMS

In column 6, line 30, please delete "firm" and substitute therefor --fire--.

Signed and Sealed this

Second Day of October, 1990

*Attest:*

*Attesting Officer*

HARRY F. MANBECK, JR.

*Commissioner of Patents and Trademarks*